US011493050B2

(12) United States Patent
Zhang et al.

(10) Patent No.: US 11,493,050 B2
(45) Date of Patent: Nov. 8, 2022

(54) FAN

(71) Applicants: GD MIDEA ENVIRONMENT APPLIANCES MFG CO., LTD., Guangdong (CN); MIDEA GROUP CO., LTD., Foshan (CN)

(72) Inventors: Huanming Zhang, Guangdong (CN); Li Liang, Guangdong (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 17/258,072

(22) PCT Filed: Dec. 26, 2018

(86) PCT No.: PCT/CN2018/123810
§ 371 (c)(1),
(2) Date: Jan. 5, 2021

(87) PCT Pub. No.: WO2020/010809
PCT Pub. Date: Jan. 16, 2020

(65) Prior Publication Data

US 2021/0190082 A1 Jun. 24, 2021

(30) Foreign Application Priority Data

Jul. 9, 2018 (CN) ..... 201810751046.5
Jul. 9, 2018 (CN) ..... 201821084637.3

(51) Int. Cl.
*F04D 25/08* (2006.01)
*F04D 25/16* (2006.01)
(Continued)

(52) U.S. Cl.
CPC ..... *F04D 25/163* (2013.01); *F04D 25/08* (2013.01); *F04D 25/166* (2013.01);
(Continued)

(58) Field of Classification Search
CPC ..... F04D 25/08; F04D 25/163; F04D 25/166; F04D 29/325; F04D 29/384;
(Continued)

(56) References Cited

U.S. PATENT DOCUMENTS 2,004,571 A * 6/1935 De Bothezat ..... F04D 19/024 415/68
3,421,428 A * 1/1969 Schutze ..... F24F 13/10 454/244
(Continued)

FOREIGN PATENT DOCUMENTS

CN 102135298 A 7/2011
CN 102705269 A 10/2012
(Continued)

OTHER PUBLICATIONS

World Intellectual Property Organization (WIPO) International Search Report and Written Opinion for PCT/CN2018/123810 with translation Apr. 2, 2019 15 Pages.
(Continued)

*Primary Examiner* — Ninh H. Nguyen
(74) *Attorney, Agent, or Firm* — Anova Law Group PLLC

(57) ABSTRACT

A fan includes a support, a motor mounted at the support and including a first rotation shaft, a first blade mounted at one end of the first rotation shaft, a transmission mechanism mounted at the support and connected to another end of the first rotation shaft, and a second blade. The transmission mechanism includes a second rotation shaft. A rotation direction of the second rotation shaft is opposite to a rotation
(Continued)

direction of the first rotation shaft. The second blade is mounted at the second rotation shaft. A tilt direction of the first blade is opposite to a tilt direction of the second blade.

20 Claims, 7 Drawing Sheets

(51) Int. Cl.
*F04D 29/38* (2006.01)
*F04D 29/32* (2006.01)

(52) U.S. Cl.
CPC ..... *F04D 29/325* (2013.01); *F04D 29/384* (2013.01); *F05D 2260/4031* (2013.01)

(58) Field of Classification Search
CPC ..... F05D 2260/4031; F05D 2260/226; F05D 2260/40311
See application file for complete search history.

(56) References Cited

U.S. PATENT DOCUMENTS 6,752,587 B2 * 6/2004 Lin ..... F04D 25/166 415/220
8,951,012 B1 * 2/2015 Santoro ..... F04D 25/06 416/128
10,987,704 B2 * 4/2021 Davies ..... F04D 29/703
2006/0276122 A1 * 12/2006 Cheng ..... F24F 7/007 454/254
2009/0165736 A1 * 7/2009 Takeuchi ..... F04D 25/166 123/41.11
2011/0174011 A1 * 7/2011 Kim ..... F24F 1/40 62/426
2018/0342940 A1 * 11/2018 Cheng ..... F04D 25/166

FOREIGN PATENT DOCUMENTS

| | | | |
|---|---|---|---|
| CN | 104776043 | A | 7/2015 |
| CN | 106968973 | A | 7/2017 |
| CN | 107218237 | A | 9/2017 |
| CN | 207229425 | U | 4/2018 |
| CN | 108869358 | A | 11/2018 |
| JP | 2001050191 | A | 2/2001 |
| JP | 2006342795 | A | 12/2006 |
| JP | 2014238059 | A | 12/2014 |

OTHER PUBLICATIONS

Japan Patent Office (JPO) The Notice of Reasons for Refusal For JP Application No. 2020-568444 dated Sep. 14, 2021 10 Pages (Translation Included).

* cited by examiner

FAN

CROSS-REFERENCE TO RELATED APPLICATIONS

This application is a National Stage Entry under 35 U.S.C. § 371 of International Application No. PCT/CN2018/123810, filed on Dec. 26, 2018, which claims priority to Chinese Application Nos. 201810751046.5 and 201821084637.3, both filed on Jul. 9, 2018 and entitled "FAN," the entire disclosures of all of which are incorporated herein by reference.

TECHNICAL FIELD

The present disclosure relates to the technical field of household appliances, in particular to a fan.

BACKGROUND

Electric fans can be divided into ceiling fans, table fans, floor fans, wall fans, ventilation fans, air-conditioning fans, etc. according to different functions and forms, and can be divided into axial fans, tubular fans, centrifugal fans and cross flow fans according to different air inlet and outlet manners. Household table fans and floor fans are mostly axial fans. Generally, the air volume of household table fans and floor fans is small, and the air volume is relatively large in high gear. However, when the air volume is large in high gear, there will be a loud noise, and the use environment is usually indoor, the impact of noise will be greater. Besides, the axial fan has a single air outlet mode, which cannot be applied to the situation where the air supply distance is far and the situation where the air supply distance is short. For example, when the living room area is large, the air supply distance of ordinary household floor fans is difficult to ensure blowing from one side of the living room to the other side of the living room, especially when in the swinging blowing mode, the air supply distance is even shorter. When the bedroom area is small and it is needed to supply air for the elderly or infants, the felt speed is high because of the short distance, which is not good to the health of the elderly or infants.

SUMMARY

The main objective of the present disclosure is to provide a fan, which aims to solve the problem of loud noise generated by the current household fan when the air supply is large that affects the life and rest of the user.

In order to achieve the above objective, the present disclosure provides a fan, including: a support; a motor mounted at the support, the motor having a first rotation shaft, both ends of the first rotation shaft extending out of the motor; a first blade mounted at one end of the first rotation shaft; a transmission mechanism mounted at the support and connected to another end of the first rotation shaft, the transmission mechanism including a second rotation shaft, a rotation direction of the second rotation shaft being opposite to a rotation direction of the first rotation shaft; and a second blade mounted at the second rotation shaft, a tilt direction of the first blade being opposite to a tilt direction of the second blade such that the first blade and the second blade blow air in a same direction when rotating in opposite directions.

In an embodiment, the transmission mechanism also includes a reverse wheel set and a mounting plate; the mounting plate is fixed to the support; the reverse wheel set includes a drive wheel, an output wheel and a transmission wheel set; the first rotation shaft is connected to the drive wheel, and the second rotation shaft is connected to the output wheel; and the transmission wheel set is configured to connect the drive wheel with the output wheel to cause a rotation direction of the output wheel to be opposite to a rotation direction of the drive wheel.

In an embodiment, the reverse wheel set is a gear set, and the transmission wheel set is meshed with the drive wheel and the output wheel.

In an embodiment, the transmission wheel set includes a first gear, a second gear, a third gear, and a third rotation shaft connecting the first gear with the second gear; the drive wheel is meshed with the first gear and is mounted at one side of the mounting plate; the third gear is meshed with the second gear and the output wheel; the second gear, the third gear and the output wheel are mounted at another side of the mounting plate; and the drive wheel, the first gear, the second gear, the third gear and the output wheel are all external gears.

In an embodiment, a radius of the drive wheel is $r_0$, a radius of the first gear is $r_1$, a radius of the second gear is $r_2$, and a radius of the output wheel is R; a torsion angle of the first blade is $\theta_1$, and a torsion angle of the second blade is $\theta_2$; a number of the first blade is $n_1$, and a number of the second blade is $n_2$; and a product of a ratio of the number of the first blade to the number of the second blade and a ratio of the torsion angle of the first blade to the torsion angle of the second blade and a ratio of a rotation speed of the first blade to a rotation speed of the second blade is a first difference coefficient, the ratio of the rotation speed of the first blade to the rotation speed of the second blade is $$\frac{\omega_1}{\omega_2}, \frac{\omega_1}{\omega_2}$$

is equal to $$\frac{r_1}{r_2} \cdot \frac{R}{r_0},$$

the first difference coefficient $k_1$ is equal to $$\frac{n_1\theta_1 r_1 R}{n_2\theta_2 r_2 r_0},$$

and $k_1$ is no less than 0.6 and no greater than 1.67.

In an embodiment, the first difference coefficient $k_1$ is no less than 0.8 and no greater than 1.2.

In an embodiment, an area of the first blade is $S_1$, an area of the second blade is $S_2$; and a product of a ratio of the area of the first blade to the area of the second blade and the first difference coefficient is a second difference coefficient, the second difference coefficient $k_2$ is equal to $$\frac{S_1}{S_2} \cdot k_1,$$

and $k_2$ is no less than 0.8 and no greater than 1.25.

In an embodiment, a length of the first blade is $l_1$, a length of the second blade is $l_2$, and a ratio of $l_1$ to $l_2$ is no less than 0.8 and no greater than 1.25.

In an embodiment, a distance between the first blade and the second blade is L, and a ratio of $l_1$ to L is no less than 1 and no greater than 3.

In an embodiment, the transmission wheel set includes a fourth gear, a fifth gear, and a fourth rotation shaft connecting the fourth gear with the fifth gear; the drive wheel is meshed with the fourth gear and is mounted at one side of the mounting plate; the fifth gear is meshed with the output wheel and is mounted at another side of the mounting plate; and the drive wheel, the fourth gear, and the fifth gear are all external gears, and the output wheel is an internal gear.

In an embodiment, a radius of the drive wheel is $r_0$, a radius of the fourth gear is $r_4$, a radius of the fifth gear is $r_5$, and a radius of the output wheel is R; a torsion angle of the first blade is $\theta_1$, and a torsion angle of the second blade is $\theta_2$; a number of the first blade is $n_1$, and a number of the second blade is $n_2$; and a product of a ratio of the number of the first blade to the number of the second blade and a ratio of the torsion angle of the first blade to the torsion angle of the second blade and a ratio of a rotation speed of the first blade to a rotation speed of the second blade is a first difference coefficient, the ratio of the rotation speed of the first blade to the rotation speed of the second blade is $$\frac{\omega_1}{\omega_2}, \frac{\omega_1}{\omega_2}$$

is equal to $$\frac{r_4}{r_5} \cdot \frac{R}{r_0},$$

the first difference coefficient $k_1$ is equal to $$\frac{n_1\theta_1 r_4 R}{n_2\theta_2 r_5 r_0},$$

and $k_1$ is no less than 2.5 and no greater than 4.

In an embodiment, the ratio of the rotation speed of the first blade to the rotation speed of the second blade $$\frac{\omega_1}{\omega_2}$$

is equal to $$\frac{r_4}{r_5} \cdot \frac{R}{r_0}, \text{ and } \frac{\omega_1}{\omega_2}$$

is no less than 3 and no greater than 4.

In an embodiment, the fan further includes an electric control board, wherein the motor is electrically connected to the electric control board; and the electric control board includes a speed adjustment module for adjusting a rotation speed of the motor and a steering adjustment module for adjusting a rotation direction of the motor.

In an embodiment, the fan further includes a third blade mounted at the first rotation shaft.

In an embodiment, the third blade is provided at an outer side of the first blade, and a length of the third blade is less than a length of the first blade.

In an embodiment, the fan further includes a fourth blade mounted at the second rotation shaft.

In an embodiment, the fourth blade is provided between the first blade and the second blade, and a length of the fourth blade is less than a length of the second blade.

In technical solutions of the present disclosure, a single-motor-driven dual-blade counter-rotating air outlet method increases the air outlet capacity of the fan. At a low speed, the demand for a larger air supply volume can be met, and the motor speed can be reduced while maintaining the air supply volume to reduce fan noise.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

DESCRIPTION OF REFERENCE NUMERALS

Figure 1:
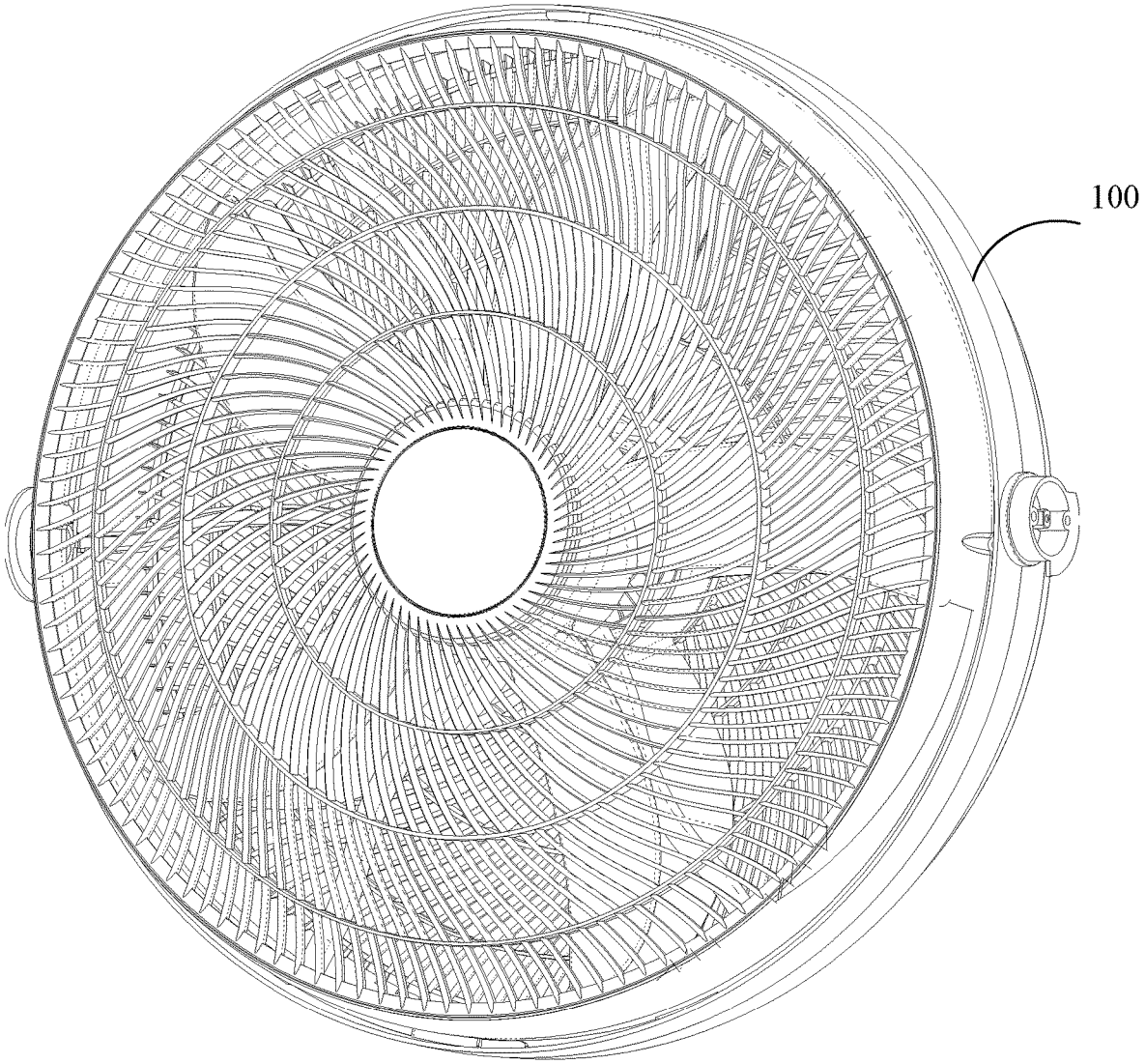
FIG. 1 is an schematic entire structural diagram of a fan according to the present disclosure.
Figure 2:
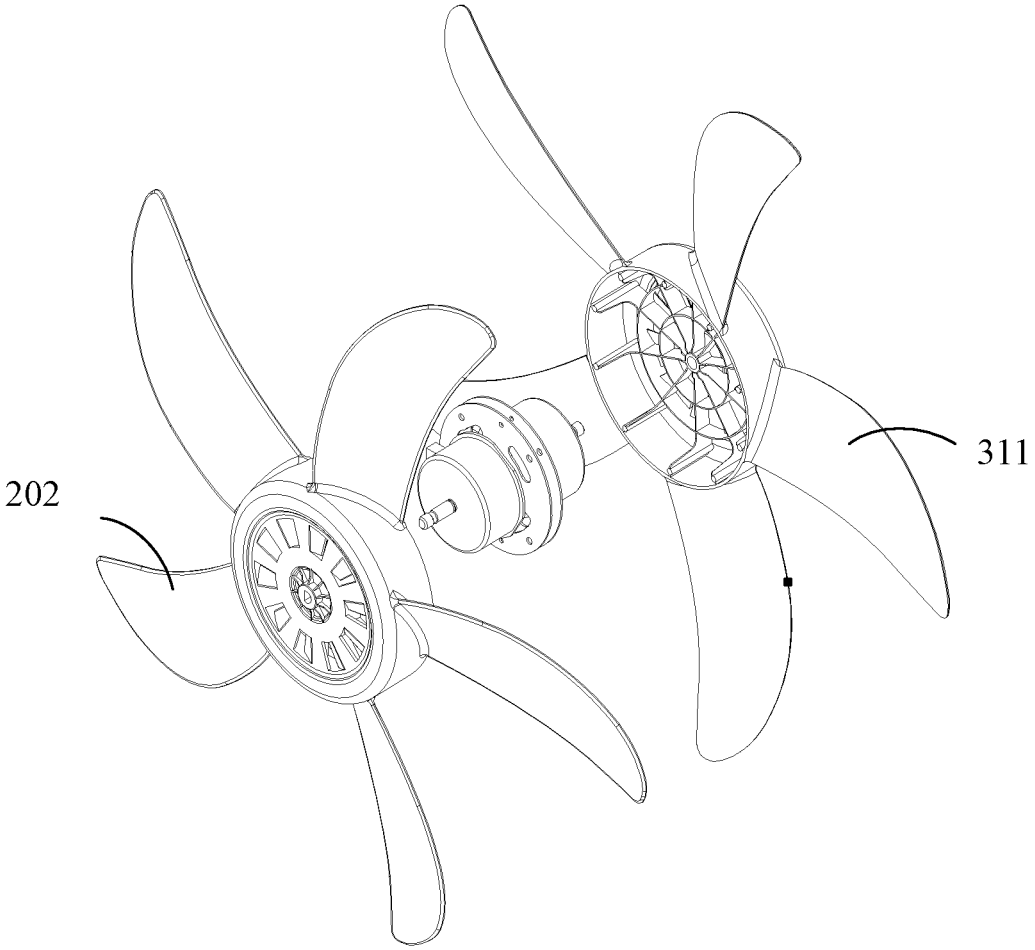
FIG. 2 is a schematic structural diagram of a blade of the fan according to the present disclosure.
Figure 3:
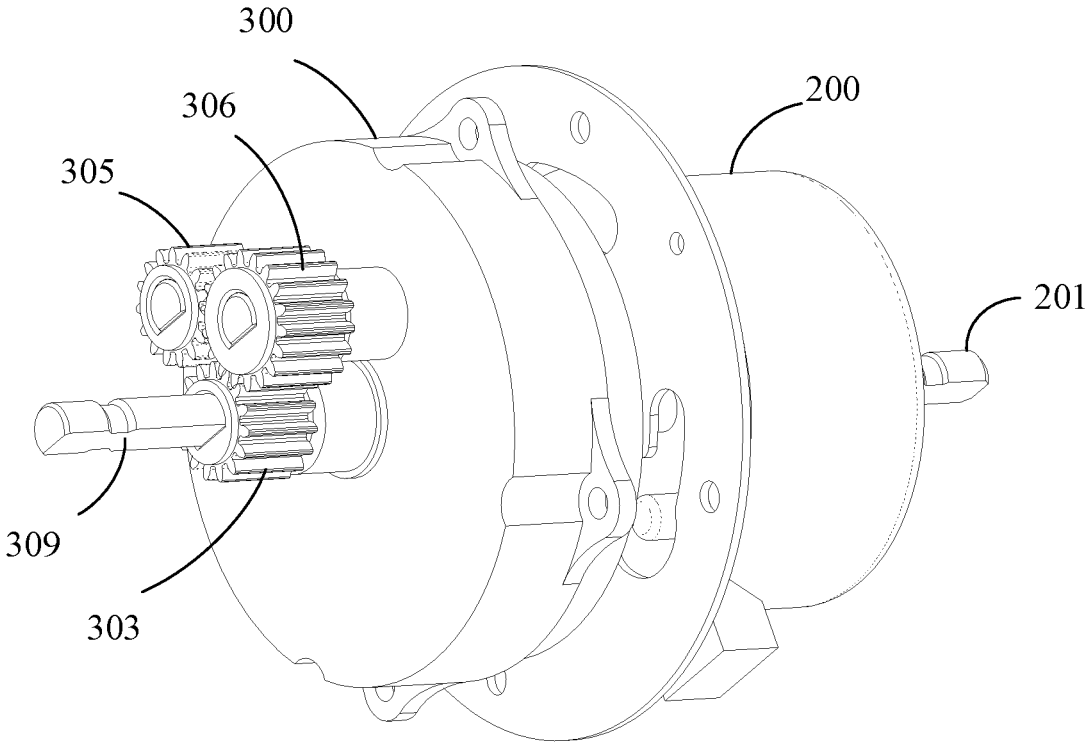
FIG. 3 is a schematic structural diagram of the fan according to an embodiment of the present disclosure.
Figure 4:
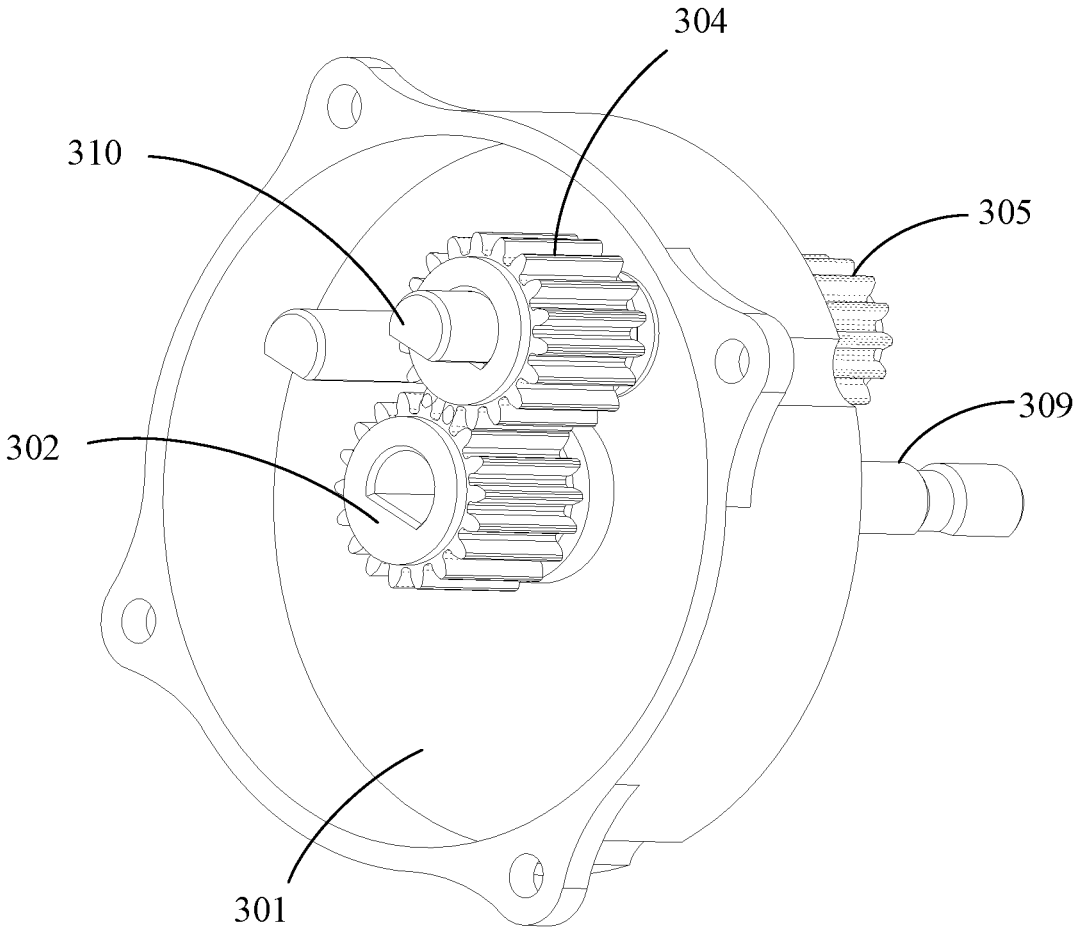
FIG. 4 is an schematic internal structural diagram of a transmission mechanism of the fan according to an embodiment of the present disclosure.

| Reference Numeral | Name |
|---|---|
| 100 | support |
| 200 | motor |
| 201 | first rotation shaft |
| 202 | first blade |
| 300 | transmission mechanism |
| 301 | mounting plate |
| 302 | drive wheel |
| 303 | output wheel |
| 304 | first gear |
| 305 | second gear |
| 306 | third gear |
| 307 | fourth gear |
| 308 | fifth gear |
| 309 | second rotation shaft |
| 310 | third rotation shaft |
| 311 | second blade |
| 400 | third blade |
| 500 | fourth blade |

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but it must be based on what can be achieved by a person of ordinary skill in the art. When the combination of technical solutions is contradictory or cannot be achieved, it should be considered that such a combination of technical solutions does not exist, nor does it fall within the scope of the present disclosure.

Axial fans such as household floor fans and table fans use a motor to drive inclined blades fixed on the motor shaft to rotate, thereby driving the air in an axial direction of the motor. This kind of fan has a simple structure and a direct air outlet manner, which is the most common application. However, the air directly pushed by the blades of this fan not only has momentum along the axial direction, but also has momentum perpendicular to a rotation axis caused by the friction between the blade and the air. The momentum of the airflow perpendicular to the rotation axis will spread the airflow. After the airflow disperses, a cross-section of the airflow beam increases, the resistance when moving in the axial direction increases sharply, resulting in a shorter effective air supply distance in the axial direction. Especially when the fan is shaking and swaying the air, the effective air supply distance in the axial direction is shorter than the air supply distance in a single direction.

Take the "Midea FS40-12DR" floor fan as an object to test the speed for the air volume table, the maximum air outlet speed of the Midea FS40-12DR is about 4 m/s, which is basically the same as other floor fans. The fan is turned on and adjusted to the highest gear, the air volume test apparatus is placed at different distances in front of the axis of the fan to detect the speed. The data is as follows:

| distance (m) | 1 | 2 | 3 | 4 | 5 |
|---|---|---|---|---|---|
| speed (m/s) | 3.85 | 2.47 | 1.65 | 0.75 | 0.6 |

From the experimental data, the attenuation of the speed of the fan is a non-linear attenuation, the higher the speed, the faster the attenuation. The speed attenuates to 1.65 m/s at 3 m, while the human body needs the speed to be around 1.6 m/s to feel the wind.

From the above test data, it can be concluded that the effective air supply distance of an ordinary floor fan is about 3 m, which is consistent with the experience in daily use.

Generally, an effective air supply distance of 3 m can meet the needs of most application scenarios, but when an axial fan such as a floor fan is turned on to a high gear, the generated noise is louder. Also, "Midea FS40-12DR" is used to conduct a gear and noise comparison test (the higher the gear, the higher the speed). "Midea FS40-12DR" has better mechanical noise control among similar products, and there is almost no noise caused by mechanical vibration or friction of components during operation. Therefore, the detected noise can be considered to be all from the noise generated when the blade blows the airflow. FS40-12DR has three gears, and the noise level corresponding to each gear is detected at a distance of two meters from the fan. The data is as follows:

| gear | 1 | 2 | 3 |
|---|---|---|---|
| noise (db) | 36.3 | 43.2 | 53.8 |

When the noise exceeds 50 decibels during the daytime and 45 decibels at night, it will interfere with normal sleep and rest. According to the acoustic environment quality standards, category 0 acoustic environment area (referring to an area that requires quietness such as rehabilitation area) requires no more than 50 decibels during the daytime and no more than 40 decibels at night. Category 1 acoustic environment area (referring to an area that need to keep quiet with residential, medical and health, cultural education, scientific research and design, administrative office as the main function) requires no more than 55 decibels during the daytime and no more than 45 decibels at night.

As can be seen, when a conventional floor fan is used at night, the noise generated at the maximum gear will significantly affect sleep and rest. Even in the daytime, the noise generated at the maximum gear does not meet the requirements of the category 0 acoustic environment area.

Therefore, the conventional floor fan with a single motor and a single blade cannot ensure sufficient effective air supply distance under the premise of maintaining sufficient silence. At the same time, the conventional floor fan cannot meet the air supply requirements of larger spaces, such as larger living rooms.

Besides, in some special application scenarios, such as supplying air for infants and young children or for the elderly in a small bedroom, what is needed is no longer a large effective air supply distance, but a soft air that disperses the airflow as soon as possible to prevent the large speed from blowing directly on the body of infants and young people or the elderly. At present, people usually turn the fan towards the wall, and use the recoil effect of the wall to the airflow to cause the airflow to quickly disperse, instead of directly adjusting the fan.

For this reason, the present disclosure provides a fan. The fan proposed in the present disclosure uses one motor and a transmission mechanism connected to the motor to separately control the two blades to rotate in opposite directions, and inclination directions of the two blades are opposite.

Therefore, when the two blades rotate in opposite directions, the air outlet directions are the same.

Specially, in an embodiment of the present disclosure, as shown in FIG. 1 to FIG. 4, the fan proposed in the present disclosure includes a support 100, a motor 200, a first blade 202, a transmission mechanism 300 and a second blade 311. The motor 200 is mounted at the support 100, the motor 200 has a first rotation shaft 201, and both ends of the first rotation shaft 201 extend out of the motor 200. The first blade 202 is mounted at one end of the first rotation shaft 201. The transmission mechanism 300 is mounted at the support 100 and connected to another end of the first rotation shaft 201. The transmission mechanism 300 includes a second rotation shaft 309. A rotation direction of the second rotation shaft 309 is opposite to a rotation direction of the first rotation shaft 201. The second blade 311 is mounted at the second rotation shaft 309. A tilt direction of the first blade 202 is opposite to a tilt direction of the second blade 311. Thus, when the first blade 202 and the second blade 311 rotate in opposite directions, the air outlet directions of the first blade 202 and the second blade 311 are towards the same side.

One end of the rotation shaft of the single-blade axial flow fan motor extends out and is connected to the blade. Both ends of the rotation shaft of the fan proposed in the present disclosure extend out of the motor 200. One end of the rotation shaft is connected to the first blade 202 for driving the first blade 202 to rotate, and another end of the rotation shaft is connected to the transmission mechanism 300, and the second rotation shaft 309 is driven by the transmission mechanism 300 to drive the second blade 311 to rotate. The transmission mechanism 300 includes a mounting plate 301 and a reverse wheel set. The reverse wheel set includes a drive wheel 302, an output wheel 303 and a transmission wheel set. The first rotation shaft 201 is connected to the drive wheel 302 to drive the drive wheel 302 to rotate. The drive wheel 302 is connected to the reverse wheel set to drive the reverse wheel set to rotate. The reverse wheel set is connected to the output wheel 303 to drive the output wheel 303 to rotate. The output wheel 303 is connected to the second rotation shaft 309 to drive the second rotation shaft 309 to rotate. A rotation direction of the output wheel 303 is opposite to a rotation direction of the drive wheel 302. The first rotation shaft 201 and the second rotation shaft 309 are coaxial.

The reverse wheel set can be driven by belt pulleys using belt friction, or can be driven by meshing between gears. The following takes gear transmission as an example for detailed description.

In this embodiment, all gears of the transmission wheel set are external gears. The transmission wheel set includes a first gear 304, a second gear 305, and a third gear 306. The first gear 304 and the second gear 305 are connected through a third rotation shaft 310. The third rotation shaft 310 is rotatably mounted on the mounting plate 301 through a shaft sleeve. Both the first gear 304 and the second gear 305 are provided with shaft holes, and are fixed on both ends of the third rotation shaft 310 through the shaft holes. The first gear 304 meshes with the drive wheel 302, and the third gear 306 meshes with the second gear 305 and the output wheel 303. The drive wheel 302 and the first gear 304 are located on one side of the mounting plate 301, and the second gear 305, the third gear 306 and the output wheel 303 are located on another side of the mounting plate 301.

The first rotation shaft 201 of the motor 200 drives the drive wheel 302 and rotates in the same direction and at the same speed as the drive wheel 302. The drive wheel 302 drives the first gear 304 and rotates opposite to the first gear 304. The second gear 305 and the first gear 304 rotate in the same direction and at the same speed through the third rotation shaft 310. The second gear 305 drives the third gear 306 and rotates opposite to the third gear 306. The third gear 306 drives the output wheel 303 and rotates opposite to the output wheel 303. The output wheel 303 drives the second rotation shaft 309 and rotates in the same direction and at the same speed as the second rotation shaft 309. The first rotation shaft 201 and the second rotation shaft 309 coaxially rotate in opposite directions through three reverse drives and three same-direction drives. The first motor 200 in turn drives the first blade 202 and the second blade 311 to coaxially rotate in opposite directions through the first rotation shaft 201, the reverse wheel set, and the second rotation shaft 309.

In this embodiment, an angular velocity of the first rotation shaft 201 is equal to an angular velocity of the drive wheel 302, and a linear velocity of the wheel circumference of the drive wheel 302 is equal to a linear velocity of the wheel circumference of the first gear 304. An angular velocity of the first gear 304 is equal to an angular velocity of the second gear 305. A linear velocity of the wheel circumference of the second gear 305 is equal to a linear velocity of the wheel circumference of the third gear 306, and a linear velocity of the wheel circumference of the third gear 306 is equal to a linear velocity of the output wheel 303.

A radius of the drive wheel 302 is $r_0$, and a linear velocity of the circumference of the drive wheel 302 is $v_0$. A radius of the first gear 304 is $r_1$, and a linear velocity of the wheel circumference of the first gear 304 is $v_1$. A radius of the second gear 305 is $r_2$, and a linear velocity of the wheel circumference of the second gear 305 is $v_2$. A radius of the output wheel 303 is R, a linear velocity of the wheel circumference of the output wheel 303 is V. An angular velocity of the first blade 202 is $\omega_1$, and an angular velocity of the second blade 311 is $\omega_2$. A ratio of a rotation speed of the first blade 202 to a rotation speed of the second blade 311 is equal to a ratio of the angular velocity of the first blade 202 to the angular velocity of the second blade 311. Specially, $$\frac{\omega_1}{\omega_2} = \frac{r_1}{r_2} \cdot \frac{R}{r_0}.$$

In technical solutions of the present disclosure, the reverse wheel set is adopted, so that one motor 200 of the fan can simultaneously drive the first blade 202 and the second blade 311 whose rotation direction and tilt direction of the blade are opposite. The first blade 202 and the second blade 311 drive the air to move in the same direction, so that the fan can obtain a greater air output capacity. Furthermore, the rotation speed of the motor 200 can be reduced on the premise of meeting the fan's air outlet demand, so as to reduce the relatively loud noise generated thereby.

Figure 5:
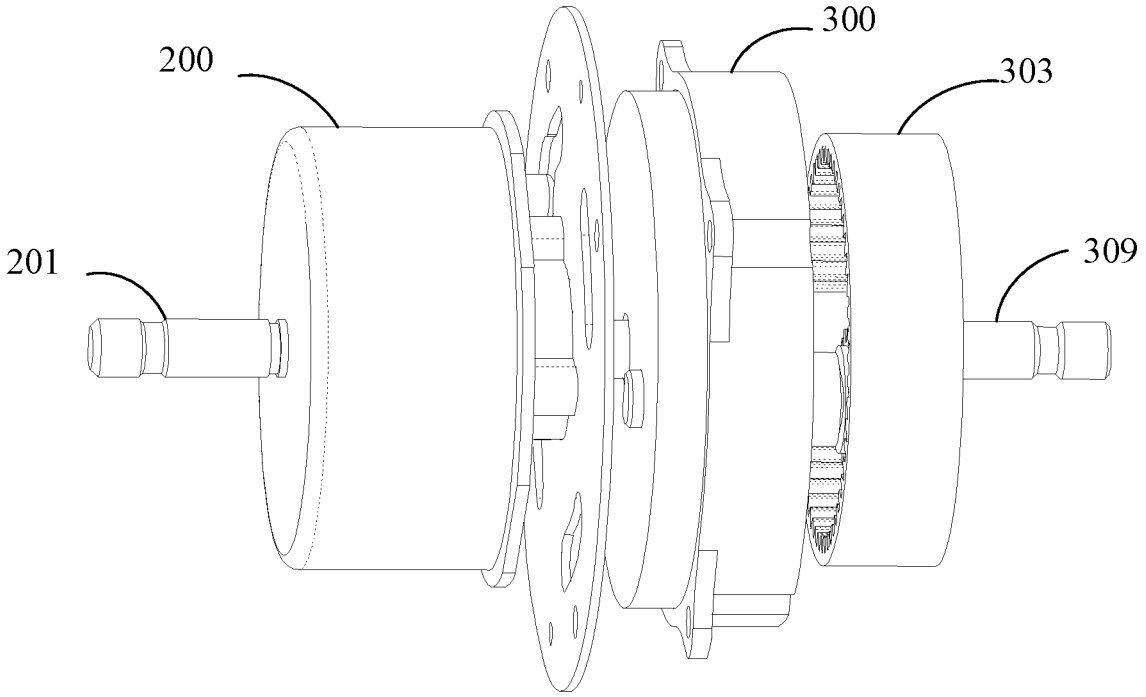
FIG. 5 is a schematic structural diagram of the fan according to another embodiment of the present disclosure.
Figure 6:
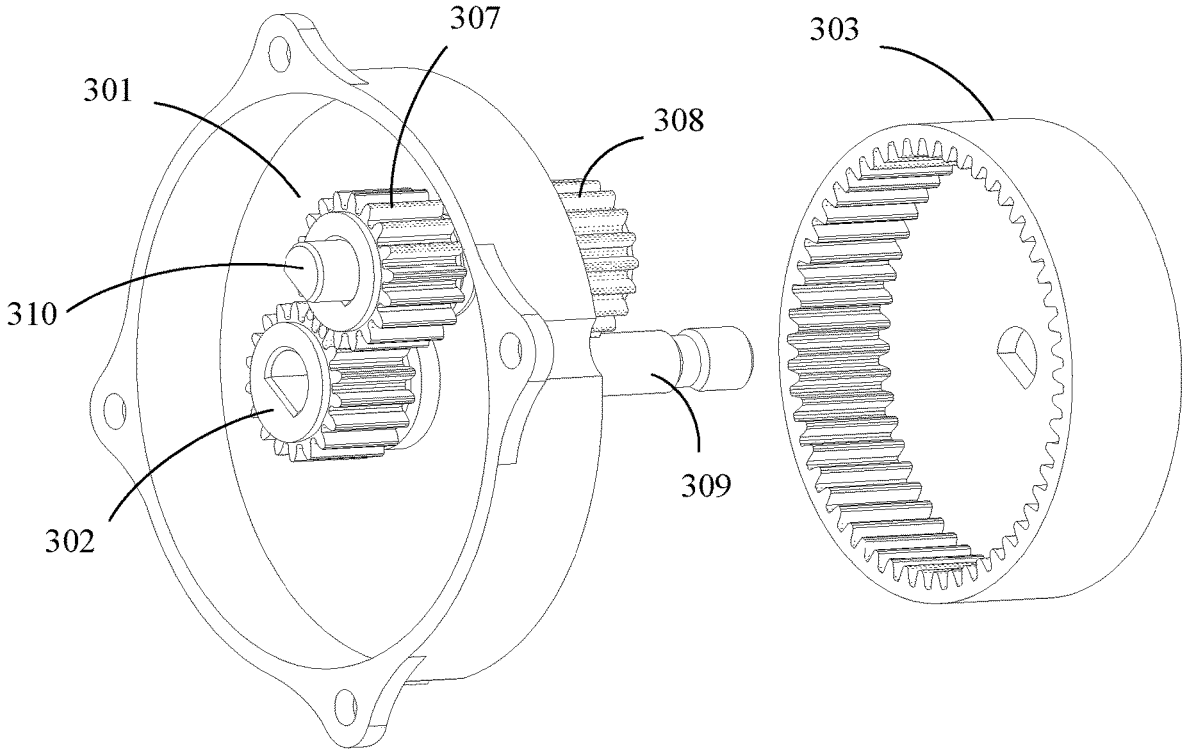
FIG. 6 is a partial exploded structural diagram of the transmission mechanism of the fan according to another embodiment of the present disclosure.

As shown in FIG. 5 and FIG. 6, the manner in which the second rotation shaft 309 and the first rotation shaft 201 coaxially rotate in opposite directions using gear drive is not limited to the specific structure of the foregoing embodiments. In other embodiments, a combination of an internal gear and an external gear can also be used to cause the second rotation shaft 309 and the first rotation shaft 201 to coaxially rotate in opposite directions. Under the combination of internal gear and external gear, the transmission wheel set includes a fourth gear 307, a fifth gear 308, and a fourth rotation shaft configured to connect the fourth gear 307 with the fifth gear 308. The drive wheel 302 is meshed with the fourth gear 307 and is mounted at one side of the mounting plate 301. The fifth gear 308 is meshed with the output wheel 303 and is mounted at another side of the mounting plate 301. The drive wheel 302, the fourth gear 307, and the fifth gear 308 are all external gears, and the output wheel 303 is an internal gear.

In this embodiment, the first rotation shaft 201 drives the drive wheel 302 and rotates in the same direction and at the same speed as the drive wheel 302. The drive wheel 302 drives the fourth gear 307 and rotates opposite to the fourth gear 307. The fifth gear 308 rotates in the same direction and at the same speed as the fourth gear 307 through the fourth shaft. The fifth gear 308 drives the output wheel 303 and rotates in the same direction as the output wheel 303. The output wheel 303 drives the second rotation shaft 309 and rotates in the same direction and at the same speed as the second rotation shaft 309. The first rotation shaft 201 and the second rotation shaft 309 coaxially rotate in opposite directions through one reverse drive and three same-direction drives. The first motor 200 in turn drives the first fan blade 202 and the second fan blade 311 to coaxially rotate in opposite directions through the first rotation shaft 201, the reverse wheel set, and the second rotation shaft 309.

In this embodiment, the angular velocity of the first rotation shaft 201 is equal to the angular velocity of the drive wheel 302. The linear velocity of the wheel circumference of the drive wheel 302 is equal to the linear velocity of the wheel circumference of the fourth gear 307. The angular velocity of the fourth gear 307 is equal to the angular velocity of the fifth gear 308. The linear velocity of the wheel circumference of the fifth gear 308 is equal to the linear velocity of the wheel circumference of the output wheel 303.

The radius of the drive wheel 302 is $r_0$, and the linear velocity of the circumference of the drive wheel 302 is $v_0$. A radius of the fourth gear 307 is $r_4$, and a linear velocity of the wheel circumference of the fourth gear 307 is $v_4$. A radius of the fifth gear 308 is $r_5$, and a linear velocity of the wheel circumference of the fifth gear 308 is $v_5$. The radius of the output wheel 303 is R, a linear velocity of the wheel circumference of the output wheel 303 is V. The angular velocity of the first blade 202 is $\omega_1$, and the angular velocity of the second blade 311 is $\omega_2$. A ratio of a rotation speed of the first blade 202 to a rotation speed of the second blade 311 is equal to a ratio of the angular velocity of the first blade 202 to the angular velocity of the second blade 311. Specially, $$\frac{\omega_1}{\omega_2} = \frac{r_4}{r_5} \cdot \frac{R}{r_0}.$$

Besides, in this embodiment, since the output wheel 303 is an external gear, and it needs to satisfy that the output wheel 303 is coaxial with the first shaft 201 and the second shaft 309, the radius R of the output wheel 303, the radius $r_0$ of the drive wheel 302, the radius $r_4$ of the fourth gear 307, and the radius $r_5$ of the fifth gear 308 satisfy:

$$R-r_5=r_0+r_4$$

Compared with the previous embodiment, the number of gears of the transmission wheel set of this embodiment is reduced, and the number of transmission stages is reduced. Therefore, this embodiment has a higher energy transmission ratio and lower energy loss than the previous embodiment. However, the output wheel 303 of this embodiment is an external gear, and other gears are internal gears, which requires a larger radius R of the output wheel 303. As a result, the value of $$\frac{\omega_1}{\omega_2}$$

is relatively large, which is suitable for the situation of differential counter-rotation and large difference in speed.

For a conventional fan with a single motor and a single blade, when an output power of the motor 200 is constant, factors that affect the fan's air output capacity (mainly including air output and effective air supply distance) include a number of blades, an area of a single blade, a twist angle of the blade (the angle between a width direction of the blade and a direction of linear velocity of the blade when the blade is rotating), a length of the blade, a width of the blade and a speed of the blade etc. The contributions of these factors to the fan's air output capacity are not simply superimposed, but will have a certain impact on each other. For example, when the blade is equivalent to a rectangle, the area of a single blade is the product of the length and the width of the blade. When the area of a single blade is constant, the greater the length of the blade, the greater the total air output of the fan. However, the relationship between the length of the blade and the effective air supply distance of the fan is not consistent. If the length of the blade is too large or too small, the effective air supply distance of the fan will be reduced.

For the single-motor dual-blade counter-rotating fan proposed in the present disclosure, the two blades influence each other, and the proportional relationship of various factors between the two blades will also have a greater impact on the fan's air output capacity. Take the first rotation shaft 201 as the rotation shaft in the air output direction as an example, the description is as follows:

When the airflow generated by the rotation of the second blade 311 flows through the first blade 202, it has a vertical momentum in addition to the axial momentum, that is, it also has a moment of inertia for circumferential rotation. The direction of the moment of inertia in the circumferential direction changes under the rebound action of the first blade 202 and becomes the momentum mainly along the axial direction. Ideally, it is possible to achieve the purpose of converting all the moment of inertia into axial momentum by controlling the relationship between the rotation speed and the torsion angle of the first blade 202 and the second blade 311. The axial momentum of the airflow driven by the second blade 311 will be further accelerated when passing through the first blade 202, but a partial component perpendicular to the axial direction is also generated, which weakens the fan's axial air outlet capacity to a certain extent.

The airflow driven by the blade has a large disturbance, and the various parameters of the blade are fixed. Therefore, in actual situations, the first blade 202 cannot convert all the moment of inertia of the airflow driven by the second blade 311 into axial momentum, but the actual maximum conversion effect can be achieved through parameter setting. That is to say, the specific parameters of the first blade 202 and the second blade 311 can be set to converge the airflow to achieve the maximum effect of axial air outlet, so as to enhance the air supply capacity of the fan. Meanwhile, it is also possible to adjust the specific parameters of the first blade 202 and the second blade 311 so that the axial momentum of the fan's air output can be more converted into circumferential momentum. Therefore, the fan obtains a soft wind mode in which the airflow can quickly disperse, which is suitable for small bedrooms and situations where air is supplied to infants or the elderly.

The ratio of the axial component of the airflow driven by the second blade 311 by the first blade 202 to the vertical component is related to the twist angle of the first blade 202. The smaller the twist angle, the smaller the ratio, but at the same time, the driving effect of the first blade 202 on the airflow is smaller.

The factors that affect the air outlet capacity of the axial fan include the speed ω, the length l of the blade, the total area S of the blade, the number of blades n, and the twist angle θ of the blade. For a single blade axial fan, the above-mentioned influencing factors are basically positively correlated with the air output capacity. But for the axial fan with double blades, the ratio of various factors and the distance L between the two blades will also have a significant impact on the fan's air output capacity.

In order to study the relationship between the factors that affect the fan's air output capacity, a series of experiments are designed using the reduced element substitution method on the basis of the controlled variable method, as follows:

Since the relationship between the number, torsion angle and rotation speed of the two blades has a greater impact on the ratio between the axial component and the vertical component when the fan discharges the air, a product of a ratio of a number of the first blade 202 to a number of the second blade 311 and a ratio of a torsion angle of the first blade 202 to a torsion angle of the second blade 311 and a ratio of a rotation speed of the first blade 202 to a rotation speed of the second blade 311 is a first difference coefficient $k_1$. A product of a ratio of an area of the first blade 202 to an area of the second blade 311 and the first difference coefficient $k_1$ is a second difference coefficient $k_2$. The torsion angle of the first blade 202 is $\theta_1$, and the torsion angle of the second blade 311 is $\theta_2$. The number of the first blade 202 is $n_1$, and the number of the second blade 311 is $n_2$. The area of the first blade 202 is $S_1$, and the area of the second blade 311 is $S_2$. The length of the first blade 202 is $l_1$, and the length of the second blade is $l_2$. A distance between the first blade 202 and the second blade 311 is L. The ratio of the rotation speed of the first blade 202 to the rotation speed of the second blade 311 is related to the radius of each gear of the reverse wheel set. The radius of the drive wheel 302 is $r_0$, the radius of the first gear 304 is $r_1$, the radius of the second gear 305 is $r_2$, and the radius of the output wheel is R.

When the gears of the transmission wheel set are external gears, the test is as follows:

The ratio of the rotation speed of the first blade 202 to the rotation speed of the second blade 311

$$\frac{\omega_1}{\omega_2}$$

is equal to $$\frac{r_1}{r_2}\cdot\frac{R}{r_0}.$$

The first difference coefficient $k_1$ is equal to $$\frac{n_1\theta_1 r_1 R}{n_2\theta_2 r_2 r_0}.$$

The second difference coefficient $k_2$ is equal to $$\frac{S_1}{S_2}\cdot k_1.$$

The first group: $k_1$ as the only variable

| $k_1$ | 0.5 | 0.6 | 0.7 | 0.8 | 0.9 | 1.0 | 1.1 | 1.2 | 1.3 |
|---|---|---|---|---|---|---|---|---|---|
| air output ($m^3$/h) | 831 | 864 | 904 | 937 | 976 | 970 | 945 | 915 | 874 |
| air supply distance (m) | 7.5 | 8 | 8 | 8.5 | 9 | 9 | 8.5 | 8 | 7.5 |

The second group: $k_2$ as the only variable

| $k_2$ | 0.6 | 0.7 | 0.8 | 0.9 | 1.0 | 1.1 | 1.2 |
|---|---|---|---|---|---|---|---|
| air output ($m^3$/h) | 971 | 994 | 1020 | 1069 | 1077 | 1031 | 965 |
| air supply distance (m) | 9 | 9 | 10 | 10.5 | 10.5 | 10 | 9 |

The third group:

$$\frac{\omega_1}{\omega_2}$$

as the only variable

| $\frac{\omega_1}{\omega_2}$ | 0.6 | 0.7 | 0.8 | 0.9 | 1.0 | 1.1 | 1.2 |
|---|---|---|---|---|---|---|---|
| air output ($m^3$/h) | 963 | 1134 | 1240 | 1284 | 1278 | 1269 | 1197 |
| air supply distance (m) | 11 | 12.5 | 13 | 13.5 | 13.5 | 13 | 12.5 |

The fourth group:

$$\frac{l_1}{l_2}$$

as the only variable

| $\frac{l_1}{l_2}$ | 0.7 | 0.8 | 0.9 | 1.0 | 1.1 | 1.2 |
|---|---|---|---|---|---|---|
| air output ($m^3$/h) | 924 | 963 | 1032 | 999 | 975 | 922 |
| air supply distance (m) | 8.5 | 9 | 9.5 | 9.5 | 9 | 8.5 |

The fifth group:

$$\frac{l_1}{L}$$

as the only variable

| $\frac{l_1}{L}$ | 0.2 | 0.4 | 0.6 | 0.8 | 1.0 | 1.2 | 1.4 |
|---|---|---|---|---|---|---|---|
| air output ($m^3$/h) | 837 | 965 | 1000 | 1012 | 998 | 971 | 901 |
| air supply distance (m) | 8 | 9 | 9.5 | 9.5 | 9.5 | 9 | 8.5 |

In the above five groups of experiments, when the only variable is selected, the parameters of the variable increase or decrease but the variable is kept unchanged. For example, take $k_1$ as the only variable in the first group of experiments, keep $k_1$ unchanged, increase $$\frac{n_1}{n_2},$$

reduce $$\frac{\theta_1}{\theta_2},$$

keep $$\frac{n_1}{n_2}\cdot\frac{\theta_1}{\theta_2} \text{ and } \frac{r_1}{r_2}\cdot\frac{R}{r_0}$$

unchanged, conduct multiple experiments, exclude the abnormal data when the parameters of $k_1$ vary greatly, and take the average value of multiple experiments with higher consistency.

From the above five groups of experiments, it can be concluded that for the counter-rotating fan, the air supply distance is approximately proportional to the air output, and it can be concluded that the convergency of the air flow is good. The respective preferred value intervals can be obtained, the preferred value interval of the first difference coefficient $k_1$ is [0.6, 1.2], and the optimal value interval is [0.8, 1.2]. The preferred value interval of the second difference coefficient $k_2$ is [0.8, 1.1]. The preferred value interval of $$\frac{\omega_1}{\omega_2}$$

is [0.8, 1.2]. The preferred value interval of $$\frac{l_1}{l_2}$$

is [0.8, 1.1]. The preferred value interval of $$\frac{l_1}{L}$$

is [0.4, 1.2].

The fan of the present disclosure further includes an electric control board. The motor 200 is electrically connected to the electric control board; and the electric control board includes a speed adjustment module for adjusting a rotation speed of the motor 200 and a steering adjustment module for adjusting a rotation direction of the motor 200. The fan proposed in the present disclosure can be switched between forward and reverse air outlet through the direction adjustment module. The above test data and the preferred value interval are established in the self-normal wind mode, when the fan discharges air in the reverse direction, the air inlet and the air outlet are interchanged, and the relationship between the first blade 202 and the second blade 311 is also exchanged accordingly. Therefore, in this embodiment, in order to take into account the ability of positive wind and the ability of reverse wind, the value interval of the first difference coefficient and the second difference coefficient shall be the reciprocal of the maximum and minimum values of the preferred interval and the optimal interval obtained from the experiment. Then take the maximum value between the current number and the reciprocal to obtain the preferred value interval and the optimal value interval in this embodiment. For example, from the above experimental data, the preferred value interval of the first difference coefficient is [0.6, 1.2]. The reciprocal of 0.6 is 1.67, and the reciprocal of 1.2 is 0.83. Thus, the preferred value interval of the first difference coefficient is [0.6, 1.67]. In the same way, it can be concluded that the optimal value interval of the first difference coefficient is [0.8, 1.25]; the optimal value interval of the second difference coefficient is [0.8, 1.25].

When the transmission wheel set is an internal gear set using internal gears and external gears, and the side of the second blade 311 is the air outlet direction, the test is as follows:

The ratio of the rotation speed of the first blade 202 to the rotation speed of the second blade 311

$$\frac{\omega_1}{\omega_2}$$

is equal to $$\frac{r_4}{r_5}\cdot\frac{R}{r_0}.$$

The first difference coefficient $k_1$ is equal to $$\frac{n_1\theta_1 r_4 R}{n_2\theta_2 r_5 r_0}.$$

The second difference coefficient $k_2$ is equal to $$\frac{S_1}{S_2}\cdot k_1.$$

The sixth group:

$$\frac{\omega_1}{\omega_2}$$

as the only variable

| $\frac{\omega_1}{\omega_2}$ | 2 | 2.5 | 3 | 3.5 | 4 | 4.5 | 5 |
|---|---|---|---|---|---|---|---|
| air output ($m^3$/h) | 903 | 874 | 855 | 820 | 786 | 743 | 700 |
| air supply distance (m) | 3.5 | 3.5 | 3 | 2.5 | 2 | 1.5 | 1.5 |

The seventh group: $k_1$ as the only variable

| $k_1$ | 2 | 2.5 | 3 | 3.5 | 4 | 4.5 |
|---|---|---|---|---|---|---|
| air output ($m^3$/h) | 932 | 900 | 886 | 851 | 762 | 714 |
| air supply distance (m) | 3.5 | 3 | 3 | 2.5 | 2 | 1.5 |

When the only variable is selected, the parameters of the variable increase and decrease but the variable is kept unchanged. For example, take $k_1$ as the only variable in the first group of experiments, keep $k_1$ unchanged, increase $$\frac{n_1}{n_2},$$

reduce $$\frac{\theta_1}{\theta_2},$$

keep $$\frac{n_1}{n_2}\cdot\frac{\theta_1}{\theta_2} \text{ and } \frac{r_1}{r_2}\cdot\frac{R}{r_0}$$

unchanged, conduct multiple experiments, exclude the abnormal data when the parameters of $k_1$ vary greatly, and take the average value of multiple experiments with higher consistency.

Compared with the first five experiments, the above two groups of experiments clearly show that the air supply distance is significantly shortened when the air output is the same. At this time, the air flow from the fan quickly spreads and the air is soft.

Combining the air output and the air supply distance, when $$\frac{\omega_1}{\omega_2}$$

$\in$[3, 4] or when $k_1\in$[2.5, 4], the soft air mode of the fan is more suitable.

The above-mentioned embodiment is a specific embodiment of a fan using double blades. In order to further increase the air supply distance of the fan, the present disclosure also proposes another embodiment on the basis of double blades.

Figure 7:
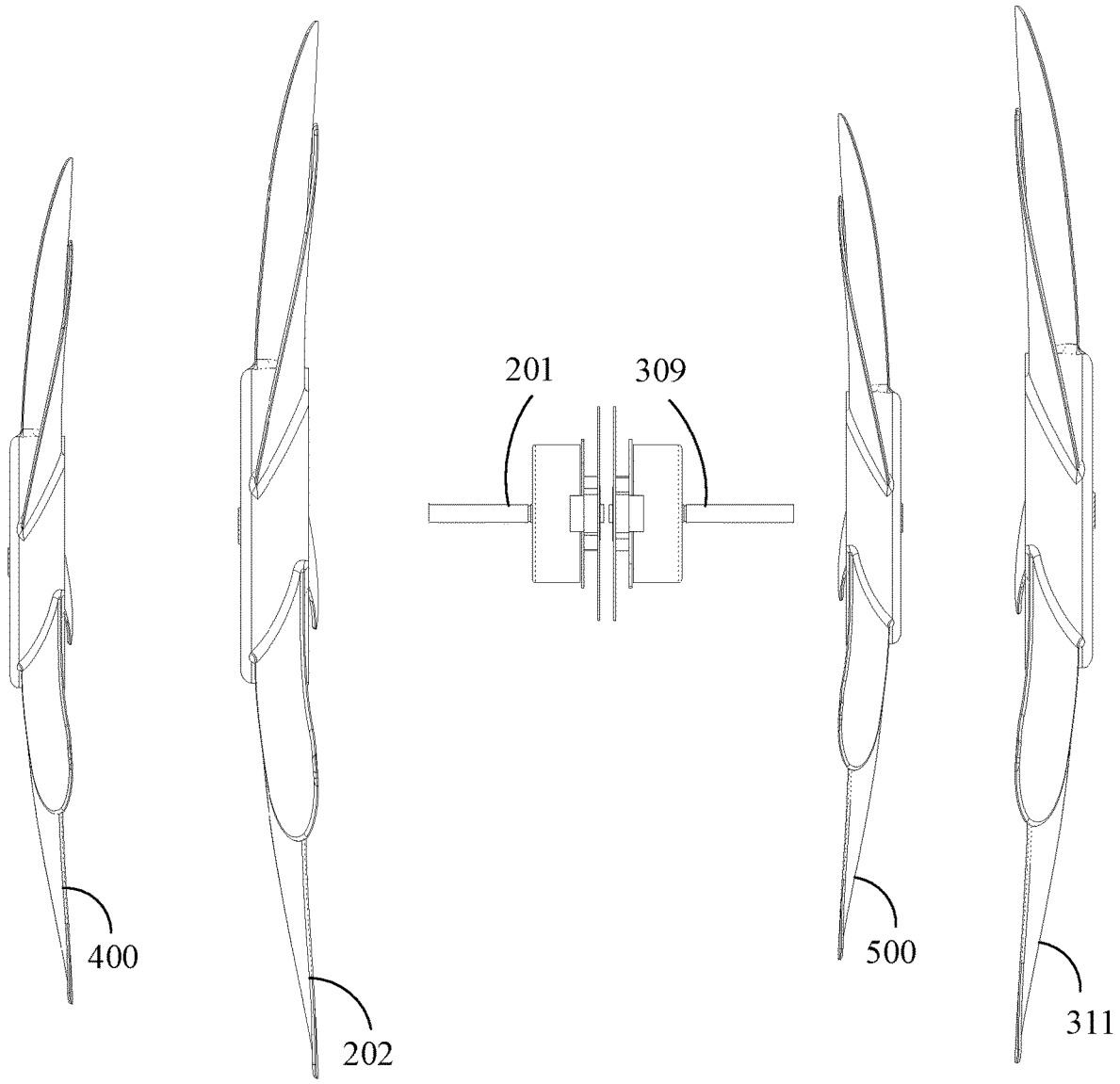
FIG. 7 is a schematic structural diagram of the blade according to yet another embodiment of the present disclosure.

As shown in FIG. 7, the fan in this embodiment further includes a third blade 400, and the addition of the third blade 400 can perform further rectification adjustment on the basis of the double blades to whirl the wind to increase the farthest air supply distance. Specifically, the third blade 400 is mounted at the first rotation shaft 202. The third blade 400 is provided on the opposite side of the first blade 201 and the second blade 301. In addition, a length of the third blade 400 is smaller than the length of the first blade 201.

The blade changes the velocity and direction of the airflow. When two sets of blades are used, the airflow can be adjusted twice, and the two sets of blades can be set and adjusted specifically to achieve the purpose of artificially adjusting the air outlet effect. Accordingly, the present disclosure proposes the embodiments of the above two sets of blades. However, when the airflow flows, it is obstructed by the surrounding air, so the boundary of the airflow has greater instability. The airflow can be divided into the center area of the airflow stream and the boundary area of the airflow stream. In contrast, the flow velocity in the center area of the air stream has a greater impact on the air supply distance, while the air stream boundary area has a greater impact on the air supply angle. Therefore, the present disclosure provides an embodiment of adding a rectifying blade on the basis of the above-mentioned double blades.

The third blade 400 is a rectifying blade, which is mainly used to adjust the proportion and flow velocity of the central area of the airflow beam. It has been achieved that under the condition of the same total power, the rectifying blade can obtain a longer air supply distance by adjusting the range and ratio of the central area and the boundary area of the airflow beam.

On this basis, in order to improve the stability of the fan during operation and further improve the rectifying capability of the rectifying blade, the present disclosure provides yet another embodiment. In this embodiment, the fan further includes a fourth blade 500, and the fourth blade 500 is mounted at the second rotation shaft 302 and provided between the first blade 201 and the second blade 301. Similarly, a length of the fourth blade 500 is smaller than the length of the second blade 301. It should be pointed out that the rectifying blade can adopt the third blade 400 or the fourth blade 500 alone, or the third blade 400 and the fourth blade 500 can be provided at the same time.

The rectifying blade cooperates with the first blade 201 and the second blade 311 to make the airflow more adjustable. The rectifying blade additionally drives the airflow, and the additional driving action is concentrated in the central area of the air beam, and the area ratio and the flow rate ratio of the central area and the boundary area of the air beam generated by the fan can be adjusted, so as to obtain a longer air supply distance.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A fan comprising:

a support;

a motor mounted at the support and including a first rotation shaft;

a first blade mounted at one end of the first rotation shaft;

a transmission mechanism mounted at the support and connected to another end of the first rotation shaft, the transmission mechanism including a second rotation shaft, a rotation direction of the second rotation shaft being opposite to a rotation direction of the first rotation shaft; and a second blade mounted at the second rotation shaft, a tilt direction of the first blade being opposite to a tilt direction of the second blade;

wherein:

the first blade and the second blade are arranged at two opposite sides of the transmission mechanism, respectively;

the first rotation shaft is coaxial with the second rotation shaft through the transmission mechanism; and the motor is between the first blade and the second blade along a direction parallel to the first rotation shaft and the second rotation shaft.

2. The fan of claim 1, wherein:

the transmission mechanism further includes a reverse wheel set including a drive wheel, an output wheel and a transmission wheel set;

the first rotation shaft is connected to the drive wheel, and the second rotation shaft is connected to the output wheel; and the transmission wheel set is configured to connect the drive wheel with the output wheel to cause a rotation direction of the output wheel to be opposite to a rotation direction of the drive wheel.

3. The fan of claim 2, wherein the reverse wheel set includes a gear set, and the transmission wheel set is meshed with the drive wheel and the output wheel.

4. The fan of claim 3, wherein:

the transmission wheel set includes a first gear, a second gear, a third gear, and a third rotation shaft connecting the first gear with the second gear;

the drive wheel is meshed with the first gear;

the third gear is meshed with the second gear and the output wheel; and each of the drive wheel, the first gear, the second gear, the third gear, and the output wheel includes an external gear.

5. The fan of claim 4, wherein:

the transmission mechanism further includes a mounting plate fixed to the support;

the drive wheel is mounted at one side of the mounting plate; and the second gear, the third gear, and the output wheel are mounted at another side of the mounting plate.

6. The fan of claim 4, wherein:

the first blade is one of one or more first blades mounted at the one end of the first rotation shaft, and the second blade is one of one or more second blades mounted at the second rotation shaft;

a radius of the drive wheel is $r_0$, a radius of the first gear is $r_1$, a radius of the second gear is $r_2$, and a radius of the output wheel is R;

a torsion angle of the one of the one or more first blades is $\theta_1$, and a torsion angle of the one of the one or more second blades is $\theta_2$;

a number of the one or more first blades is $n_1$, and a number of the one or more second blades is $n_2$; and a difference coefficient $k_1$ equal to $$\frac{n_1\theta_1 r_1 R}{n_2\theta_2 r_2 r_0}$$

is no less than 0.6 and no greater than 1.67.

7. The fan of claim 6, wherein the difference coefficient $k_1$ is no less than 0.8 and no greater than 1.2.

8. The fan of claim 6, wherein:

the difference coefficient $k_1$ is a first difference coefficient;

an area of the one of the one or more first blades is $S_1$, an area of the one of the one or more second blades is $S_2$; and a second difference coefficient $k_2$ equal to $$\frac{S_1}{S_2}\cdot k_1$$

is no less than 0.8 and no greater than 1.25.

9. The fan of claim 8, wherein a length of the one of the one or more first blades is $l_1$, a length of the one of the one or more second blades is 12, and a ratio of $l_1$ to $l_2$ is no less than 0.8 and no greater than 1.25.

10. The fan of claim 9, wherein a distance between the one of the one or more first blades and the one of the one or more second blades is L, and a ratio of $l_1$ to L is no less than 1 and no greater than 3.

11. The fan of claim 3, wherein:

the transmission wheel set includes a first gear, a second gear, and a third rotation shaft connecting the first gear with the second gear;

the drive wheel is meshed with the first gear;

the second gear is meshed with the output wheel; and each of the drive wheel, the first gear, and the second gear includes an external gear, and the output wheel includes an internal gear.

12. The fan of claim 11, wherein:

the transmission mechanism further includes a mounting plate fixed to the support;

the drive wheel is mounted at one side of the mounting plate; and the second gear is mounted at another side of the mounting plate.

13. The fan of claim 11, wherein:

the first blade is one of one or more first blades mounted at the one end of the first rotation shaft, and the second blade is one of one or more second blades mounted at the second rotation shaft;

a radius of the drive wheel is $r_0$, a radius of the first gear is $r_4$, a radius of the second gear is $r_5$, and a radius of the output wheel is R;

a torsion angle of the one of the one or more first blades is $\theta_1$, and a torsion angle of the one of the one or more second blades is $\theta_2$;

a number of the one or more first blades is $n_1$, and a number of the one or more second blades is $n_2$; and a difference coefficient $k_1$ equal to $$\frac{n_1\theta_1 r_4 R}{n_2\theta_2 r_5 r_0}$$

is no less than 2.5 and no greater than 4.

14. The fan of claim 13, wherein $$\frac{r_4}{r_5}\cdot\frac{R}{r_0}$$

is no less than 3 and no greater than 4.

15. The fan of claim 1, further comprising:

an electric control board electrically connected to the motor and including a speed adjustment module for adjusting a rotation speed of the motor and a steering adjustment module for adjusting a rotation direction of the motor.

16. The fan of claim 1, furthering comprising:

a third blade mounted at the first rotation shaft.

17. The fan of claim 16, wherein the third blade is provided at an outer side of the first blade that is opposite to the motor, and a length of the third blade is less than a length of the first blade.

18. The fan of claim 16, further comprising:

a fourth blade mounted at the second rotation shaft.

19. The fan of claim 18, wherein the fourth blade is provided between the first blade and the second blade, and a length of the fourth blade is less than a length of the second blade.

20. A fan comprising:

a support;

a motor mounted at the support and including a first rotation shaft;

a first blade mounted at one end of the first rotation shaft;

a transmission mechanism mounted at the support and connected to another end of the first rotation shaft, the transmission mechanism including:

a second rotation shaft, a rotation direction of the second rotation shaft being opposite to a rotation direction of the first rotation shaft; and a reverse wheel set including a drive wheel connected to the first rotation shaft, an output wheel connected to the second rotation shaft, and a transmission wheel set meshed with the drive wheel and the output wheel and configured to connect the drive wheel with the output wheel to cause a rotation direction of the output wheel to be opposite to a rotation direction of the drive wheel;

wherein:

the transmission wheel set includes a first gear, a second gear, a third gear, and a third rotation shaft connecting the first gear with the second gear;

the drive wheel is meshed with the first gear;

the third gear is meshed with the second gear and the output wheel; and each of the drive wheel, the first gear, the second gear, the third gear, and the output wheel includes an external gear; and a second blade mounted at the second rotation shaft, a tilt direction of the first blade being opposite to a tilt direction of the second blade.

* * * * *